US008827847B2

(12) United States Patent
Johnson

(10) Patent No.: US 8,827,847 B2
(45) Date of Patent: Sep. 9, 2014

(54) TRAINING AID

(76) Inventor: Vernon Ralph Johnson, Rochedale South (AU)

( * ) Notice: Subject to any disclaimer, the term of this patent is extended or adjusted under 35 U.S.C. 154(b) by 213 days.

(21) Appl. No.: 13/377,865

(22) PCT Filed: Jun. 16, 2010

(86) PCT No.: PCT/AU2010/000744
§ 371 (c)(1),
(2), (4) Date: Dec. 13, 2011

(87) PCT Pub. No.: WO2010/144958
PCT Pub. Date: Dec. 23, 2010

(65) Prior Publication Data

US 2012/0088612 A1 Apr. 12, 2012

(30) Foreign Application Priority Data

Jun. 17, 2009 (AU) ..... 2009902777

(51) Int. Cl.
*A63B 69/00* (2006.01)
*A63B 69/36* (2006.01)

(52) U.S. Cl.
CPC ..... *A63B 69/3632* (2013.01); *A63B 2220/40* (2013.01)
USPC ..... 473/453; 473/422; 473/463; 473/232

(58) Field of Classification Search
USPC ..... 473/422, 450, 458, 464, 220, 224, 457, 473/233, 461, 232
See application file for complete search history.

(56) References Cited

U.S. PATENT DOCUMENTS

| | | | | | |
|---|---|---|---|---|---|
| 3,113,781 | A | * | 12/1963 | Guier | 473/234 |
| 4,267,793 | A | * | 5/1981 | Lane et al. | 473/453 |
| 4,270,753 | A | * | 6/1981 | Maroth et al. | 473/233 |
| 4,363,488 | A | * | 12/1982 | Maroth et al. | 473/233 |
| 4,515,368 | A | * | 5/1985 | Petitjean | 473/224 |

(Continued)

FOREIGN PATENT DOCUMENTS

| | | |
|---|---|---|
| GB | 2409172 | 6/2005 |
| JP | 60-104172 U | 7/1985 |

(Continued)

OTHER PUBLICATIONS

International Search Report in corresponding international application No. PCT/AU2010/000744.

(Continued)

*Primary Examiner* — Mitra Aryanpour
(74) *Attorney, Agent, or Firm* — Cowan, Liebowitz & Latman, P.C.; Mark Montague

(57) ABSTRACT

A training aid (10) provides real-time biometric feedback for swung or linearly accelerated implements where the feedback is provided above a user adjustable threshold. The training aid (10) includes a two-part housing (12) and mounting means for releasably mounting the housing to an implement. A battery (16) is located in the housing (12) with a buzzer (22) connected to the battery (16) through an electrical circuit. A force activated switch (14) in the electrical circuit is activated to energize the buzzer (22) to sound in response to displacement of the training aid. The force activated switch (14) has a force threshold at which the force activated switch (14) is activated to energize the buzzer (22) to sound. The force activated switch (14) is configured so that the force threshold is user adjustable.

10 Claims, 10 Drawing Sheets

(56) References Cited

U.S. PATENT DOCUMENTS

| | | | | | |
|---|---|---|---|---|---|
| 4,759,219 | A | * | 7/1988 | Cobb et al. | 73/493 |
| 4,763,284 | A | * | 8/1988 | Carlin | 702/41 |
| 4,789,160 | A | * | 12/1988 | Dollar et al. | 473/223 |
| 4,852,875 | A | * | 8/1989 | McLennan et al. | 473/461 |
| 4,967,596 | A | * | 11/1990 | Rilling et al. | 473/463 |
| 4,991,850 | A | | 2/1991 | Wilhlem | |
| 5,082,283 | A | * | 1/1992 | Conley et al. | 473/234 |
| 5,439,217 | A | * | 8/1995 | Ganger, Sr. | 473/202 |
| 5,446,775 | A | * | 8/1995 | Wright et al. | 377/24.2 |
| 5,688,183 | A | * | 11/1997 | Sabatino et al. | 473/212 |
| 5,741,182 | A | * | 4/1998 | Lipps et al. | 463/36 |
| 5,868,634 | A | | 2/1999 | Choi et al. | |
| 5,895,328 | A | * | 4/1999 | Pahio | 473/224 |
| 5,984,799 | A | | 11/1999 | Romano | |
| 6,032,530 | A | * | 3/2000 | Hock | 73/379.01 |
| 6,607,450 | B1 | * | 8/2003 | Hackman | 473/223 |
| 2009/0143159 | A1 | | 6/2009 | Murph et al. | |
| 2012/0088612 | A1 | * | 4/2012 | Johnson | 473/422 |
| 2013/0023353 | A1 | * | 1/2013 | Wright | 473/224 |

FOREIGN PATENT DOCUMENTS

| | | | |
|---|---|---|---|
| JP | 63-212380 | A | 9/1988 |
| JP | 2002-529210 | A | 9/2002 |
| WO | 00/29075 | A1 | 5/2000 |

OTHER PUBLICATIONS

Feb. 25, 2014 Japanese Office Action, that issued in Japanese Patent Application No. 2012-515286.

* cited by examiner

TRAINING AID

FIELD OF THE INVENTION

The invention relates to an athletic training aid, and in particular to a training aid with audible swing speed feedback.

BACKGROUND

In sports and pastimes that employ a hand held elongated implement like a bat, hammer, stick, racket, club, or the like, the implement is swung to impact a stationary or moving target like a ball or puck. The amount of energy transferred from the implement to the target is proportional to the speed at which the implement is swung and the effectiveness of the transfer of energy is related to good technique, which includes good balance, timing and tempo. It has been found that the most efficient transfer of energy between a swung implement and the intended target occurs when the implement is still accelerating at the moment of impact. This has been variously referred to as follow through, power transfer, and Ki in Martial Arts, amongst many other terms. The same holds true for linear acceleration of a sports implement such as a javelin.

Using sound as a signal path to the human brain has been established as a very effective bio-feedback pathway, as it can be integrated, in real-time, into most human physical activity at both a conscious and sub-conscious level. Also, the presence of sound associated with a physical activity is not of itself a distraction from the activity, in the way that flash or strobe lighting, or harnesses with image targets or wiring might be.

Further, as a general principle the use of a real-time bio-feedback does not require any metric or finite measure to be output or recorded. A bio-feedback instrument only needs to provide an indicative response to the user that suggests that the user is moving a chosen biological or physical parameter in a positive direction or trend.

A number of patent applications have been filed for devices which provide swing data. United States Patent Application US2006/0052173 in the name of Telford teaches a swing speed analyser releasably mounted on a golf club and includes an accelerometer and a display to display swing speed at impact. Telford does not, however, provide real-time biometric feedback to the user. U.S. Pat. No. 7,160,200 and U.S. Pat. No. 6,261,102 both teach audio biometric feedback systems having accelerometers on an implement to be swung, transmitters of the signal generated by the accelerometer and a remote receiver for receiving the signal. The described preferred embodiments of these systems thus comprise two discrete parts and as such may be cumbersome, complex and not entirely user friendly. During bio-feedback, it may be helpful if feedback is only provided during a part of the swing when swing speed exceeds a threshold. None of the prior art systems provide an adjustable swing speed threshold from which audible feedback is provided.

OBJECT OF THE INVENTION

It is an object of the invention to overcome or at least alleviate one or more of the above problems and/or provide the consumer with a useful or commercial choice.

It is another object of the invention to provide an improved real-time biometric feedback training aid for swung or linearly accelerated implements.

SUMMARY OF THE INVENTION

In one form, although it need not be the only or indeed the broadest form, the invention relates to a training aid including:

a housing;

mounting means for releasably mounting the housing to an implement;

a battery within the housing;

a sound generator connected to the battery through an electrical circuit; and a force activated switch in the electrical circuit which is activated to energise the sound generator to sound in response to displacement of the training aid, the displacement of the training aid causing a force to be exerted on the force activated switch, wherein the force activated switch:

has a force threshold at which the force activated switch is activated to energise the sound generator to sound, and is adapted so that the force threshold is user adjustable.

In another form, the invention relates to a method of providing real-time audible biometric feedback during swinging of an implement, the method including:

mounting a training aid to the implement; and setting a swing speed threshold at which a sound generator of the training aid sounds when swinging the implement.

BRIEF SUMMARY OF THE DRAWINGS

Preferred embodiments of the invention will be described with respect to the accompanying drawings, of which.

DETAILED DESCRIPTION OF PREFERRED EMBODIMENTS

Figure 1:
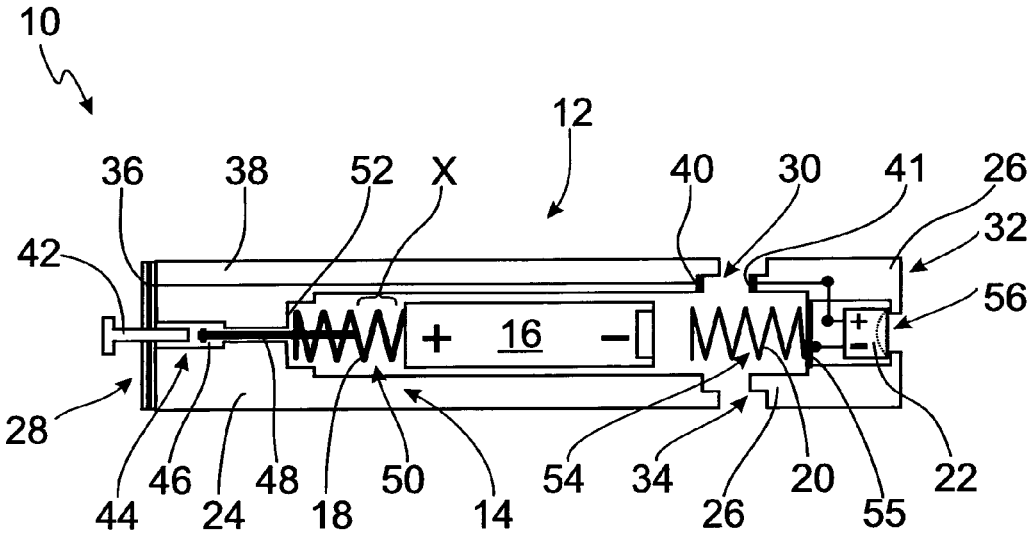
FIG. 1 shows a cross-sectional side view of an electromechanical embodiment of a training aid in accordance with the invention.

Embodiments of the present invention comprise a training aid including: a housing; mounting means for releasably mounting the housing to an implement; a battery within the housing; a sound generator connected to the battery through an electrical circuit; and a force activated switch in the electrical circuit. The force activated switch has a force threshold at which the sound generator is energised and the force activated switch is configured so that the force threshold is user adjustable. The force activated switch may take many forms and include a force sensor. It will be appreciated that an accelerometer is also a force sensor as it measures the force exerted on part of the accelerometer during acceleration of the accelerometer. An electro-mechanical, electronic and digital embodiment of the force activated switch is described in the specification.

Elements of the invention are illustrated in concise outline form in the drawings, showing only those specific details that are necessary to understanding the embodiments of the present invention, but so as not to clutter the disclosure with excessive detail that will be obvious to those of ordinary skill in the art in light of the present description.

In this patent specification, adjectives such as first and second, left and right, front and back, top and bottom, etc., are used solely to define one element from another element without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention. It will be appreciated that the invention may be implemented in a variety of ways, and that this description is given by way of example only. Reference to centrifugal force is reference to the reactive force, equal and opposite to the centripetal force, drawing a rotating body away from the centre of curved motion.

With reference to FIG. 1 of the drawings, one embodiment of an electro-mechanical training aid in accordance with the invention is designated generally by reference numeral 10. The training aid 10 comprises: a two part housing 12; mounting means (not shown in the sectional view); a battery 16, a force activated switch 14 comprising the battery 16 held against a compression spring 18; and a sound generator in the form of a piezoelectric buzzer 22.

The housing 12 is split into a main body 24 and an end cap 26. The main body 24 has a closed end 28 and an open junction end 30. Similarly, the end cap 26 has a closed end 32 and an open junction end 34. The main body 24 and end cap 26 are releasably connectable at junction end 30 to junction end 34. This may for example be by means of a screw thread, twist lock or snap-fit.

The main body 24 has an electrically conductive end plate 36 at its closed end 28. The end plate 36 is electrically connected via an electrical conductor 38 to a brush ring 40 at the junction end 30 of the main body 24. Adjustment means in the form of an electrically conductive adjuster screw 42 extends through the end plate 36 so that a distal end is received in a passage 44 in the main body 24. The distal end of the adjuster screw 42 abuts a contact pin 46 which has its head captured in the passage 44. The shank 48 of the contact pin 46 projects into a chamber 50 in the main body 24, in which the battery 16 is held. The chamber 50 is open to the junction end 30 of the main body 24. The spring 18 seats against a blind end 52 of the chamber 50. The shank 48 of the contact pin 46 projects part-way into the bore of the spring 18. The spring 18 seats (with an interference fit) into a shallow drilling in the blind end 52 of the chamber 50 such that the spring 18 is positively located concentric to the walls of the chamber 50. The spring 18 is dimensioned to locate against the circular depression in the positive end of the battery 16 without making contact with the positive terminal of the battery 16.

The end cap 26 has a hollow 54 at its junction end 34, in which an electrically conductive contact plate 55 is fixed. A follower spring 20 is seated on the contact plate 55 and is also electrically conductive. The buzzer 22 is embedded into the end cap 26 with a suitable shock absorbing gel. A passage 56 extends between the buzzer 22 and the closed end 32, through which a tone emitted from the buzzer 22 can travel. The contact plate 55 is electrically connected to a brush ring 41 at the junction end 34 of the end cap 26. The contact plate 55 and brush ring 41 are connected by an electrical conductor via the buzzer 22. A negative terminal (−) of the buzzer 22 is connected to the contact plate 55 and a positive terminal (+) of the buzzer 22 is connected to the brush ring 41.

The battery 16 is a regular 12V electric battery having a positive end (+) and a negative end (−). In use, the battery 16 is located in the chamber 50 of the main body 24 with its positive end against the spring 18. The chamber 50 is closed off by the end cap 26, compressing the follower spring 20 of the end cap 26 between the negative end of the battery 16 and the contact plate 55. The configuration and engagement of the springs 18, 20 at each end of the battery 16 help centralize the battery 16 within the training aid 10, reducing friction of the battery 16 against the chamber 50 walls. The springs 18, 20 serve to locate the battery 16 concentrically in the chamber 50. This functions to minimize friction and binding of the battery 16 against the chamber walls.

The follower spring 20 has a relatively lower spring rate compared to the spring rate of the spring 18. The primary function of the follower spring 20 is to keep the battery 16 in electrical contact with the contact plate 55, while the battery 16 compresses the spring 18. Whilst the training aid 10 is stationary, the battery 16 is held at an equilibrium point between the two springs 18, 20 with the positive end of the battery 16 a distance "x" from the tip of the contact pin 46. The distance "x" is variable by turning the adjuster screw 42 to displace the contact pin 46.

With the end cap 26 fitted to the main body 24, the brush rings 40 and 41 of the main body 24 and end cap 26, respectively, are in contact. As will readily be understood, an electrical circuit is closed when the spring 18 is compressed sufficiently for the positive end of the battery 16 to contact the contact pin 46. When the electrical circuit closes, the battery 16 energizes the buzzer 22 to emit a tone.

The training aid 10 is designed, dimensioned and configured to be releasably fixed to the shaft of a sporting implement, such as a golf club, in an orientation wherein the battery 16 is substantially parallel with a longitudinal axis of the shaft and the positive end of the battery 16 is closest to the head of the golf club. As the golf club is swung in an arc, the centrifugal force acting on the battery 16 compresses the spring 18. Compression of the spring 18 is proportional to the instantaneous swing speed throughout the arcing range of motion. If the centrifugal force is sufficient to compress the spring 18 to the point where the positive end of the battery 16 touches the contact pin 46, the buzzer 22 is energized. The magnitude of the centrifugal force required to compress the spring 18 to the point where the buzzer 22 is energized is a force threshold of the switch 14. The buzzer 22 is only energized while the centrifugal force is equal or bigger than the force threshold, so any slow down in the swing can result in a disruption of the emitted tone. The threshold swing-speed at which the force threshold is reached can be set by way of the adjuster screw 42 by setting the distance "x". The combination of the battery 16 acting on the spring 18, and the contact pin 46, acts as a force activated switch for the electrical circuit to energize the buzzer 22. The combination of the spring 18, and the contact pin 46 is also a force sensor which measures when the centrifugal force is bigger than the force threshold. The force activated switch 14 is closed by displacement of the battery 16 in the chamber 50 to the point where it touches the contact pin 46 when the centrifugal force acting on the battery is bigger than the force threshold.

The training aid 10 provides simple threshold swing speed feedback to the user. The emitted tone from the buzzer 22 during the swing confirms to the user that his/her swing speed has attained the threshold swing speed. As the swing proceeds, the tone gives the user a sense of the continuation of the swing effort through and beyond the target zone and encourages good "follow through". The adjuster screw 42 provides for the threshold swing speed (proportional to the force threshold) at which the buzzer 22 is energized to be set and adjusted. This provides the flexibility to set the threshold swing speed for different sporting implements and different users of those implements.

By way of example, in using the training aid 10 with a golf club, the user takes a series of "easy" paced (¾ speed) practice swings and adjusts the adjuster screw 42 so that the tone commences at a point during the down swing just before the club head is near the back foot, this establishes the user's individual reference or threshold swing speed with that club. The user then commences a series of controlled swings, whereby the duration of the tone increases through and past the point where impact with a golf ball would have occurred. The threshold swing speed should not be achieved too early in the arc of the downswing, as this could cause the user to over swing the club, which is counter to achieving improved swing tempo and timing. A user might place markers on the ground to establish, visually, a target zone and then modify his or her swing so that the threshold is only reached through that zone.

Conversely, the user might swing the club with his or her eyes closed and then sense the increased duration of tone as it relates to the action of their swing. The user might then transfer the training aid 10 from one club to another, with adjustment to threshold swing speed so as to reinforce the training effect.

The functioning of the training aid 10 can be tested by screwing the adjuster screw 42 fully home so that the contact pin 46 is forced into electrical contact with the positive end of the of the battery 16, thereby closing the switch 14. In this state, the tone from the energized buzzer 22 will confirm proper functioning of all of the components making up the electrical circuit of the training aid 10.

Figure 2:
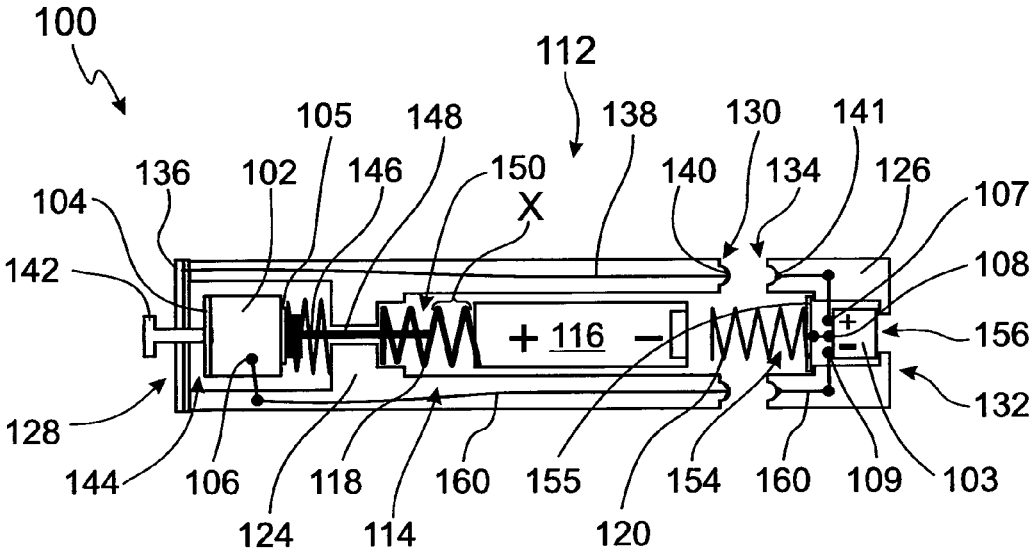
FIG. 2 shows a cross-sectional side view of another electromechanical embodiment of a training aid in accordance with the invention.

Referring to FIG. 2, another embodiment of an electromechanical training aid in accordance with the invention is designated generally by reference numeral 100. The training aid 100 is similar to the training aid 10, with the biggest difference being that the training aid 100 further includes a variable resistance force sensor 102 which controls a piezoelectric variable tone sound generator 103. Further differences will become apparent from the description of the training aid 100.

The training aid 100 comprises: a two part housing 112; mounting means (not shown in the sectional view); a battery 116, a switch 114 comprising the battery 116 held against a compression spring 118; and the piezoelectric variable tone sound generator 103.

The housing 112 is split into a main body 124 and an end cap 126. The main body 124 has a closed end 128 and a junction end 130. Similarly, the end cap 126 has a closed end 132 and a junction end 134. The main body 124 and end cap 126 are releasably connectable at junction end 130 and junction end 134.

The main body 124 has an electrically conductive end plate 136 at its closed end 128. The end plate 136 is electrically connected via an electrical conductor 138 to an electrical connector 140 at the junction end 130 of the main body 124. An adjuster screw 142 extends through the end plate 136 so that its distal end is received in a passage 144 in the main body 124.

The variable resistance force sensor 102 is housed in the passage 144. The force sensor 102 has terminals 104 and 105 at either ends of the force sensor 102. The terminals 104 and 105 are electrically connected. The adjuster screw 142 abuts the terminal 104 of the force sensor 102. The force sensor 102 further includes a variable resistance output 106, the function of which is discussed in more detail hereinbelow.

The terminal 105 of the force sensor 102 abuts a contact pin 146 which has its head captured in the passage 144. The shank 148 of the contact pin 146 projects into a chamber 150 in the main body 124, in which the battery 116 is held. The chamber 150 is open to the junction end 130. The spring 118 seats against a blind end of the chamber 150. The shank 148 of the contact pin 146 projects part-way into the bore of the spring 118.

The end cap 126 has a hollow 154 at its junction end 134, in which an electrically conductive contact plate 155 is fixed. A follower spring 120 is seated on the contact plate 155 and is also electrically conductive. The variable tone sound generator 103 is embedded into the end cap 126. A passage 156 extends between the sound generator 103 and the closed end 132, through which a tone emitted from the sound generator 103 can travel.

The sound generator 103 has a positive terminal 107, a negative terminal 108 and a control input terminal 109. The positive terminal 107 is electrically connected to an electrical connector 141 at the junction end 134 of the end cap 126. The negative terminal 108 is electrically connected to the contact plate 155. The sound generator 103 is energized by applying a voltage over the positive terminal 107 and negative terminal 108, and the frequency of the tone of the sound generator, when energised, is controlled by the variable resistance of the force sensor 102 as an input to the control input terminal 109.

The battery 116 has a positive end (+) and a negative end (−). In use, the battery 116 is located in the chamber 150 of the main body 124 with its positive end against the spring 118. The main body 124 is closed off by the end cap 126, compressing the follower spring 120 between the negative end of the battery 116 and the contact plate 155. The springs 118 and 120 are substantially similar to the springs 18 and 20 described in respect of training aid 10 and the battery is held between the springs 118 and 120 in a similar way.

With the end cap 126 fitted to the main body 124, the contact points 140 and 141 of the main body 124 and end cap 126, respectively, are in contact. As will readily be understood, an electrical circuit is closed by the switch 114 when the spring 118 is compressed sufficiently for the positive end of the battery 116 to contact the contact pin 146. When the electrical circuit closes, the sound generator 103 is energised. Closing the electrical circuit also causes the battery 116 to apply a force to the force sensor 102. The force applied to the force sensor 102 by the battery 116 is the difference between the centrifugal force acting on the battery 116 and the force threshold required to close the switch 114.

The force sensor 102 drives the frequency of the tone of the sound generator 103. The variable resistance output 106 of the force sensor 102 is connected to the control input terminal 109 of the sound generator via electrical connectors 160 which are in contact at the junction ends 130, 134 of the main body 124 and end cap 126, respectively. The frequency of the tone of the sound generator 103 is thus controlled by the force measured by the force sensor 102.

The training aid 100 is designed and configured to be releasably fixed to a shaft of a swung implement, such as a golf club, in an orientation wherein the battery 116 is substantially parallel with the shaft and the positive end of the battery 116 closest to the head of the golf club. As the golf club is swung in an arc, the centrifugal force acting on the battery 116 compresses the spring 118. If the centrifugal force is sufficient to compress the spring 118 to the point where the positive end of the battery 116 touches the contact pin 146, the sound generator 103 is energized. Once the threshold swing speed has been reached, the frequency (pitch) of the tone will increase proportional to the increase in speed of the swing and vice-versa. The user will thus have an audible feedback of the change in tempo of his/her swing, allowing the user to strive for repeatability of an ideal swing tempo.

The functioning of the training aid 100 can be tested by screwing the adjuster screw 142 fully home so that the contact pin 146 is forced into electrical contact with the positive end of the of the battery 16, thereby closing the switch 114. At this point, the force sensor 102 will be under some mechanical load and a certain resistance will be evident on the resistance output 106 of the force sensor 102. As the adjuster screw 142 is further tightened, the load on the force sensor 102 will increase slightly as the battery 116 is forced back against the follower spring 120. This increase in load will cause a change in the resistance at the resistance output 106 of the force sensor 102 and a corresponding increase in frequency of the tone of the sound generator 103. This check is easily performed to confirm that the training aid 100 is functioning properly.

Figure 3:
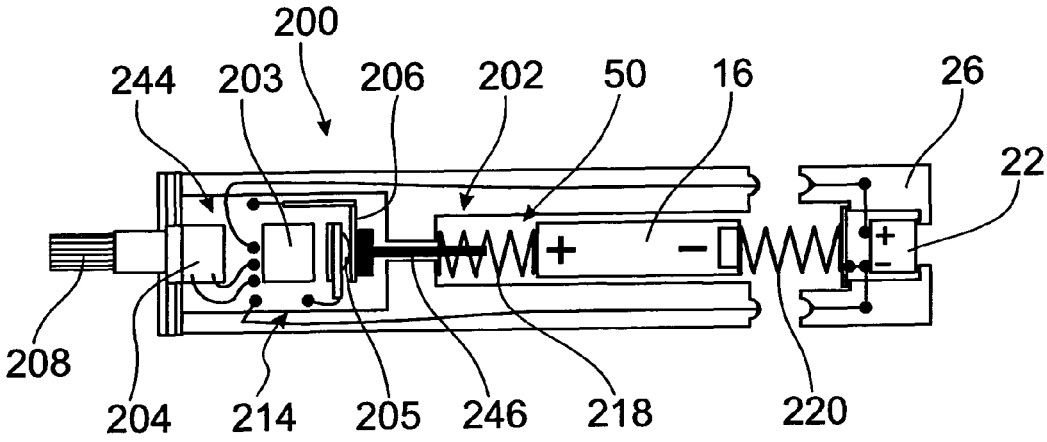
FIG. 3 shows a cross-sectional side view of an electronic embodiment of a training aid in accordance with the invention.

Referring to FIG. 3, an electronic training aid in accordance with the invention is designated generally by reference numeral 200. The electronic training aid 200 is similar to the training aid 10, with the biggest differences being that the training aid 200 includes a separate on/off switch 202 and an electronic force activated switch 214. The same reference numerals are used in FIG. 3 to refer to elements of the electronic training aid 200 which are the same as elements of the training aid 10.

The on/off switch 202 comprises the contact pin 246 and the spring 18. The on/off switch 202 is between the battery 16 and the electronic force activated switch 214. The electronic force activated switch 214 is energised only when the on/off switch 202 is closed by the positive terminal of the battery contacting the contact pin 246. The on/off switch 202 is closed when a small centrifugal force is applied to the battery 16, causing the spring 218 to compress sufficiently for the positive terminal of the battery 16 to make electrical contact with the contact pin 246.

The electronic force activated switch 214 comprises an electronics module 203, a potentiometer 204, a force sensor 205 and a contact leaf spring 206. The electronic force activated switch 214 is housed in the passage 244.

With the electronic force activated switch 214 energized, the centrifugal force applied to the force sensor 205 by the battery 16 being displaced in the chamber 50 generates a force voltage (Vf) from the force sensor 205. The contact leaf spring 206 applies a nominal preloading against the force sensor 205. Increasing centrifugal force causes the battery 16 to apply increasing force/load to force sensor 205, increasing the force voltage (Vf).

The force voltage (Vf) is output to the electronics module 203. The potentiometer 204 outputs a force threshold voltage (Vt) to the electronics module 203. The force threshold voltage (Vt) is a force threshold proportional to a swing speed threshold. The electronics module 203 compares the force voltage (Vf) with the force threshold voltage (Vt). The force threshold voltage (Vt) is set by a user by turning a knob 208 of the potentiometer 204 to a desired position. The potentiometer 204 is configured as a variable resistor in a simple voltage divider circuit in conjunction with two fixed resistors. When the force voltage (Vf) exceeds force threshold voltage (Vt) the electronic force activated switch 214 closes the electric circuit to the buzzer 22, causing the buzzer 22 to sound. The comparison of the force voltage (Vf) to the force threshold voltage (Vt) acts as an electronic centrifugal force activated switch in the same way as training aid 10 employs the battery 16, spring 18 and pin 46 as a mechanical centrifugal force activated switch.

The force sensor 205 may be any commercially suitable force sensor, and may be one of the commercially available 'conductive rubber technology' sensors available from INABA RUBBER CO. LTD Japan, and specifically the rubber dome model no. SR-D15-S. The force sensor 205 is in the form of a variable resistor having a first pin and a second pin which has a variable resistance between them which is varied depending on the force applied to the force sensor 205.

The leaf spring 206 is electrically conductive. The contact pin 246 abuts the leave spring 206. Electrical current flows through the leaf spring 206 to energize the electronic force activated switch 214 when the battery 16 contacts the contact pin 246.

Springs 218 and 220 are substantially similar to the springs 18 and 20 described in respect of training aid 10 however the battery 16 is held between the springs 218 and 220 in a more balanced way with the two spring rates more evenly matched. A relatively small centrifugal force on the battery 16 will thus close the on/off switch 202. The spring 218 spaces the positive end of the battery 16 from the contact pin 246.

As will readily be understood, an electrical circuit for the electronic force activated switch 214 is closed by the on/off switch 202 when the spring 218 is compressed sufficiently for the positive end of the battery 16 to contact the contact pin 246. When the electrical circuit closes, the force activated switch 214 is energized and any force acting on the force sensor 205 increases the force voltage (Vf) at the input of the electronics module 203. Once the force voltage (Vf) exceeds the force threshold voltage (Vt) the electric circuit for the buzzer 22 is closed. The buzzer 22 is energised to sound when the force voltage (Vf) exceeds the force threshold voltage (Vt). The training aid 200 thus operates in two stages. In a first stage the force activated switch 214 is energized and in the second stage the second stage the buzzer 22 is energised. The electronic force activated switch 214 is powered only when a centrifugal force is experienced by the battery 16, sufficient to close the on/off switch 202.

A battery check function for the training aid 200 is achieved by turning knob 208 of the potentiometer 204 to a position setting the smallest force threshold voltage and inducing a force on the battery 16 by shaking the training aid in a direction along length of the battery 16.

Figure 4:
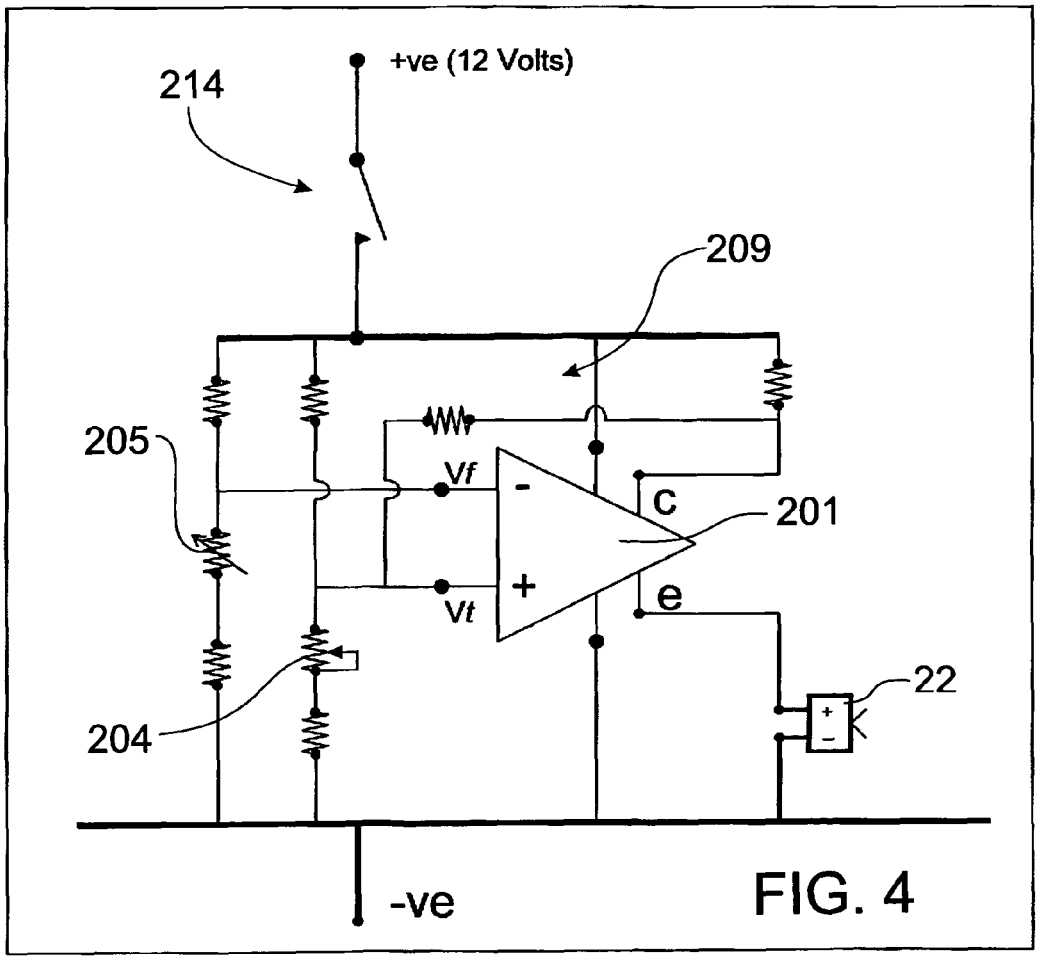
FIG. 4 shows an electronic circuit diagram of the training aid of FIG. 3.

FIG. 4 shows an electric circuit of the training aid 12. The on/off switch 214 is indicated as a simple switch. The electronics module 203 is shown including a comparator 201. The comparator 201 has a force threshold voltage (Vt) input from the potentiometer 204 and a force voltage (Vf) input from the fore sensor 205. The comparator 201 includes a hysteresis feedback circuit 209. The hysteresis feedback circuit 209 ensures that the training aid 200 switches on positively once the swing speed threshold is exceeded and remains on until the swing speed drops a defined amount below the threshold speed that was selected by the user.

Figure 5A:
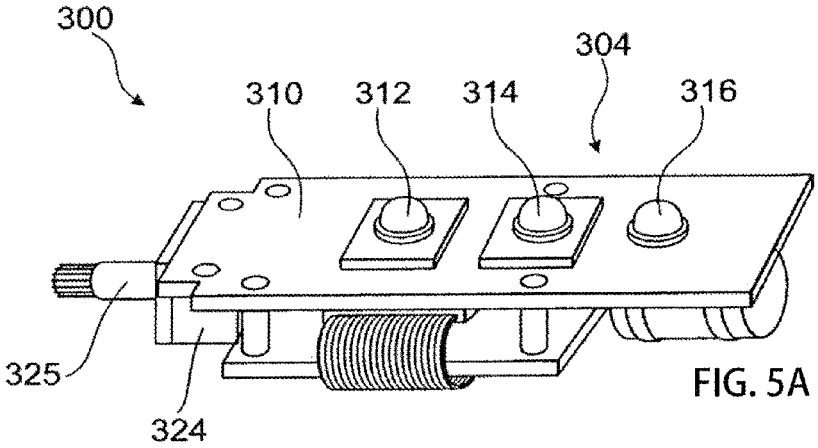
FIGS. 5A and 5B collectively show an exploded perspective view of a digital embodiment of a training aid in accordance with the invention.
Figure 5B:
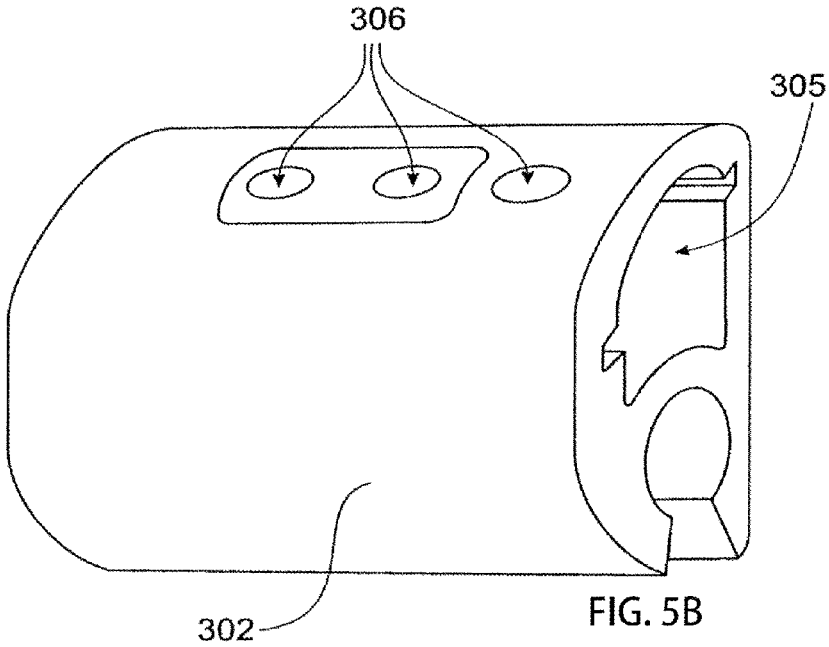

Referring to FIGS. 5A and 5B, a digital training aid in accordance with the invention is designated generally by reference numeral 300. The digital training aid 300 comprises a housing 302 and electronics 304. The electronics 304 are shown separately to the housing 302 in FIGS. 5A and 5B, but the electronics 304 are slidably received in the housing 302, in an assembled condition.

The housing 302 has a passage 305 therein in which the electronics 304 is received in an interference fit. The passage 305 is closed off by an end cap (not shown) at one end to seal the electronics 304 in the housing 302. The end cap is similar to the end cap 26 described in of the training aid 10 and includes a piezoelectric sounder. A piezoelectric sounder is a speaker capable of variable pitch. The piezoelectric sounder is energized to sound by an audio-frequency alternating electrical current. The housing 302 has a number of apertures 306 therein in which buttons and lamps of the electronics 304 is receivable.

The electronics 304 comprises a number of circuit boards and components as described in more detail with reference to FIGS. 6A, 6B and 6C. A main circuit board 310 shown in FIG. 5A has an on/off push button 312, a mode push button 314 and a light emitting diode (LED) lamp 316 in its underside. The buttons 312 and 314 are received in two of the apertures 306 in the housing 302 to be user accessible. The LED lamp 316 is received in the remaining aperture 306 to indicate status information to a user. The buttons 312, 314 may be covered by waterproof push pads and the LED lamp 316 by a window.

Figure 6A:
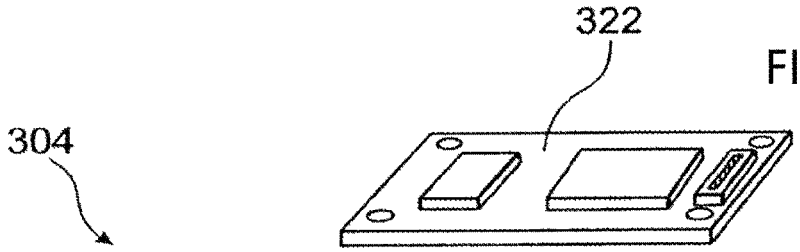
FIGS. 6A, 6B and 6C collectively show an exploded perspective view of components of the training aid of FIGS. 5A and 5B.
Figure 6B:
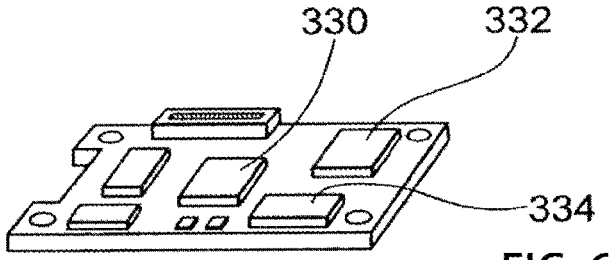
Figure 6C:
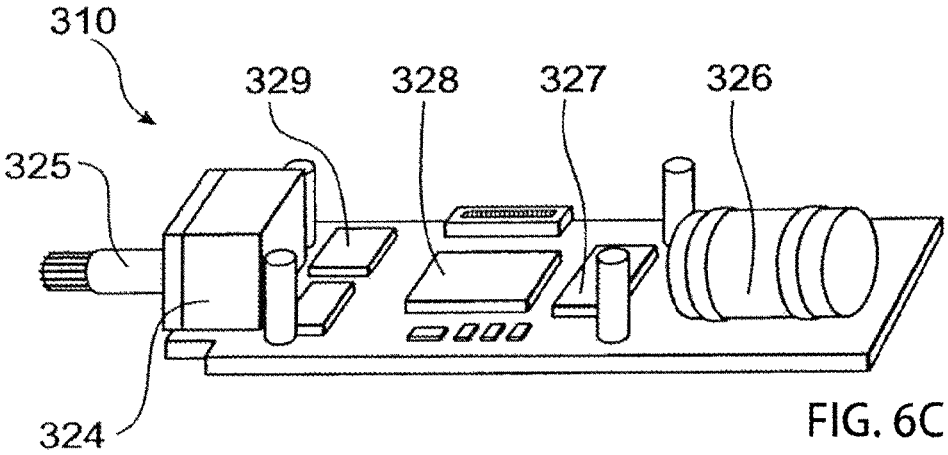

FIGS. 6A, 6B and 6C collectively show an exploded view of the electronics 304. The electronics 304 includes the main circuit board 310, a processor circuit board 320 and an ANT+ wireless communication module 322. The main circuit board 310, processor circuit board 320 and ANT+ module 322 are all connected by ribbon connectors (shown in FIG. 5A).

The main circuit board 310 has a potentiometer 324 and a battery pack 326 mounted thereto. The electronics 304 is powered by the battery pack 326. The main circuit board 310 further includes a wireless communications module 328, an accelerometer 329 and a clock 327. The potentiometer 324 has a knob 325 for adjusting the potentiometer 324. The piezoelectric sounder in the end cap is electrically connected to the main circuit board 310.

The processor circuit board 320 includes a Microprocessor Unit (MPU) 330, a shock sensor 332, a memory chip 334, as well as a number of input/output terminations for the MPU 330.

It will be appreciated that the digital training aid 300 has the same functionality as the digital training aids 10, 100 and 200 in that the sounder is energized to sound only once a force bigger than a force threshold is experienced by the training aid 300. A force activated switch of the training aid 300 includes a force sensor in the form of the accelerometer 329 outputting a force voltage (Vf) to an analog-to-digital port of the MPU 330. The analog-to-digital port outputs a digital value proportional to the magnitude of the force voltage (Vf). This digital value is compared by the MPU 330 to a force threshold. The force threshold is provided by the potentiometer 324. The potentiometer 324 outputs a force threshold voltage (Vt) which is converted to the force threshold by another analog-to-digital port of the MPU 330. The force threshold is thus a digital value derived from the potentiometer 324. Adjusting the knob 325 of the potentiometer 324 changes the digital value for the force threshold. The MPU 330 is a digital comparator for the force activated switch. The MPU 330 is configured to compare the digital value for the force voltage (Vf) to the digital value for the force threshold. The MPU 330 is operable to output a audio-frequency alternating current to the piezoelectric sounder in order to energize the sounder if the digital value of the accelerometer is determined by the MPU 330 to be bigger than the digital value for the force threshold.

Figure 7:
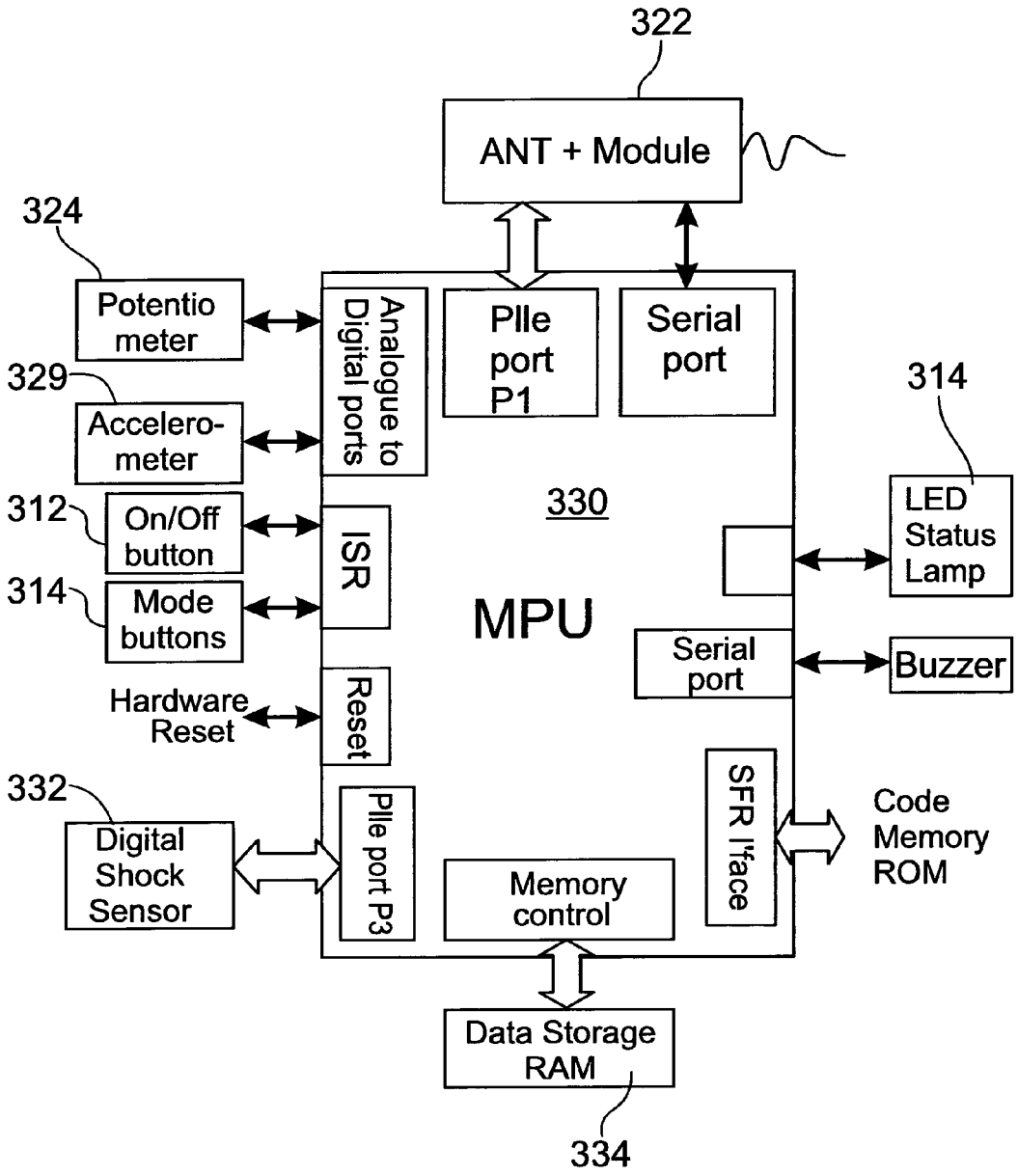
FIG. 7 shows an electronic block diagram of a microprocessor and associated sensors and components of the training aid of FIGS. 6A, 6B and 6C.

FIG. 7 is a self-explanatory diagram of the MPU 330 and the various inputs to the MPU 330 and outputs from the MPU 330.

It will be appreciated that the digital training aid 300 allows for significant sophistication in terms of the functionality that might be not be included in the electro-mechanical training aid 10 or electronic training aid 200. The description below of the functionality and use of the digital training aid 300 describes such added functionality (advanced mode). It also describes basic functionality (baseline mode). In the baseline mode the digital training aid 300 emulates the function of the more basic electro-mechanical training aid 10 or electronic training aid 200. In the advanced mode a number of user selectable functions are provided.

While the use of the MPU 330 requires a more complex user interface it also presents a more sophisticated and information rich interface with the user. The baseline user interface will include various signals generated by the MPU 330 and communicated to the user via audio tones. The LED 316 will indicate the various status levels of the training aid 300; for example, "ready", 'standby', "low battery status", "reset CPU". The buttons 312, 314 provide command input from the user to the MPU 330. Specific sequences of button pushes will register as commands to the MPU 330 and the MPU will confirm with tailored bursts of tone. User input commands such as On/Off, MPU Reset, selecting feedback sound options and function commands will be entered via the push-buttons.

The digital shock sensor 332 allows the user to communicate with the MPU via "tap-tap-tap" sequences. This allows the user to communicate with the MPU 330 without having to resort to the push buttons 312,314. As the training aid 300 is targeted for hand held elongated implements which are swung by the user, a limited menu of function commands to the MPU will be conveniently entered by tapping the implement on the ground or the heel of the free hand.

A higher order "user interface" will also be implemented in this embodiment of the training aid 300 via a wireless personal communications link, such as the ANT+ Protocol. The training aid 300 includes the ANT+ wireless communication module 322 for communication via the ANT+ Protocol. This interface between the MPU 330 and a suitable receiving module will facilitate either a mobile phone application or a bespoke software application. This higher order interface with the training aid 300 will allow down loading of data recorded and stored in the memory 334 for successive swings. The status of the MPU 330 and the battery pack 326 will also be available to the user. The interface provides for the setting of user selectable options, particularly the incremental setting of a threshold swing speed, independent of the potentiometer 324 setting on the training aid. User input commands such as On/Off, MPU Reset, commands selecting feedback sound options and function commands will be available via the wireless link.

The on/off push button 312 brings the MPU 330 out of (battery saving) deep hibernation. A sustained (e.g. 1 second) depression of the on/off push button 312 returns the training aid to hibernation. The training aid 300 always initializes/resets/powers up into baseline mode.

The proper functioning of the training aid 300 is checked by depressing both on/off button 312 and mode button 314 for a sustained (1.5 sec) period. This initiates an MPU 330 re-initialization which includes a programmed self-test protocol.

The switching or toggle between baseline and advanced modes is achieved by momentarily depressing the on/off button 312 or using the "tap-tap-tap" sequence. A slow (1 sec) flash of the status LED signifies the ready state in advanced mode.

The core function of the training aid 300 is to compare the swing speed of a sporting implement to a selected threshold speed and provide an instantaneous feedback audible signal to the user when the swing speed is greater than the selected threshold speed. With the training aid 300 in either baseline or advanced mode, this is achieved by applying signal voltages to two of the analog-to-digital ports of the MPU 330. As with the electronic training aid 200, the potentiometer 324 provides a force threshold voltage (Vt) to the MPU via an analog-to-digital port. The output force voltage (Vf) of the single axis Piezoresistive Crystal accelerometer 329 quantifies the centripetal force generated as the training aid 300 is arcuately displaced. After pre-amplification, the voltage Vf is applied to another of the analog-to-digital ports of the MPU 330. For any period of time when the MPU 330 computes that Vf exceeds Vt, the MPU 330 samples voltage Vf applied to the analog-to-digital port (at the highest practicable sample rate) and stores the data to memory 334. Simultaneously the MPU 330 causes a specific stream of data, drawn from one or multiple memory addresses, to be output at a specific rate to one of the MPU's serial ports. The sounder, which is connected to this serial port, is energised by the audio frequency square wave thus produced and emits an audible tone while the threshold speed is exceeded.

The "tap-tap-tap" user interface is achieved by employing the digital shock sensor 332 which connects via a parallel port to the MPU 330. The shock sensor 332 is arrayed to sense shock or impact loads applied to the training aid 300. The MPU 330 is programmed to respond to specific timed sequences of taps or impacts. A slow deliberate 'tap-tap-tap' switches operational modes between Baseline and Advanced. While in advanced mode a quick 'tap:tap' signals for a return to the "ready" state.

The shock sensor 332 has a second function to perform in advanced mode. During any period of time when the threshold swing speed is exceeded and data on the swing is being recorded, the shock sensor 332 will register the detection of a shock impact, such as hitting a soft target when indoors or a solid target, eg a golf or tennis ball or baseball, when outdoors. The MPU 330 will record that event as occurring at a specific point within the data stream for that swing, so as to identify when in the swing the impact occurred. i.e. between which two of the string of samples of Vf did the impact occur.

When used in baseline mode, the training aid 300 provides simple threshold swing speed feedback to the user. The constant pitch tone emitted from the sounder during the swing confirms to the user that his/her swing speed has attained a threshold swing speed the user set. As the swing proceeds, the tone gives the user a sense of the continuation of the swing effort through and beyond the target zone and encourages good "follow through".

To switch or toggle the training aid 300 in advanced mode, the user monetarily depresses the on/off button 312 or initiates a tap-tap-tap sequence. The training aid is initially brought to "ready" state via either of these actions. The user can now proceed to take a swing with the chosen implement. The data stream representing values of Vf is sampled by the MPU 330 while the threshold speed is exceeded will be held in memory 334. A short 'tap:tap' sequence communicates to the MPU the user's readiness to swing the implement again. The MPU, following a programmed sub-routine, will then translate the data stream from the previous swing, along with any impact shock detected within the threshold window, into an information rich dataset. The dataset is saved to an external data storage memory (RAM) 334. On a training aid 300 employing a wireless communication protocol and remote receiver; the raw data stream of Vf values would also be transmitted to the software application for post processing. After these actions the MPU 330 will reset all counters and registers in preparation to receive and store data on the next swing of the implement.

When the training aid 300 is in advanced mode the information dataset/s that are stored in the external memory 334 (RAM) by the MPU 330 and can be replayed by the user. A single momentary push of the MODE button will replay the most recent swing information dataset. Two successive pushes will replay the three stored datasets. Each information dataset contains a sequence of bytes which translates as audible tones, with variable pitch proportional to swing speed, when directed to the sounder. If an impact was detected during the swing, the event will be recorded as a timed break within the sequence of tones corresponding to the point in time when the impact occurred.

The information thus communicated to the user is not a direct reproduction of the event, but rather it is an extended tonal representation of the period of time the threshold swing speed was exceeded and the acceleration beyond the threshold speed. This facilitates the user getting a better sense of the swing speeds achieved during the swing and a sense of whether the club was, for instance, accelerating into impact point.

Figure 8:
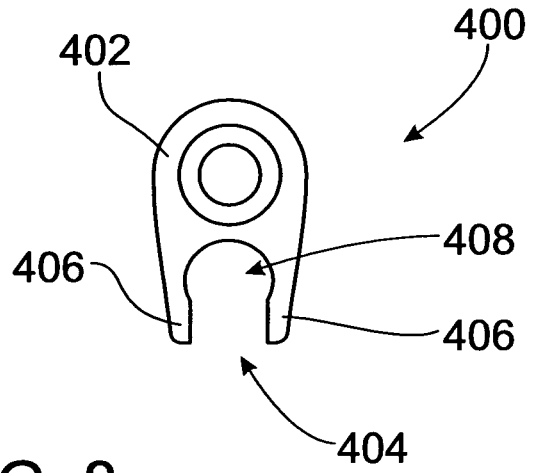
FIG. 8 shows a cross-sectional top view of one embodiment of a training aid in accordance with the invention.

Referring to FIG. 8, a cross section of a training aid 400 in accordance with the invention is shown. The training aid 400 is the same as any one of the training aids 10, 100, 200 or 300 described hereinabove. The training aid 400 includes a housing 402 and attachment means in the form of a resilient clamp 404 having spaced walls 406 and a channel 408 machined between the bases of the walls 406. The channel 408 is dimensioned to receive the shaft of a golf club. The walls 406 are resiliently deformable so that the training aid 400 can clip onto the shaft.

Figure 9:
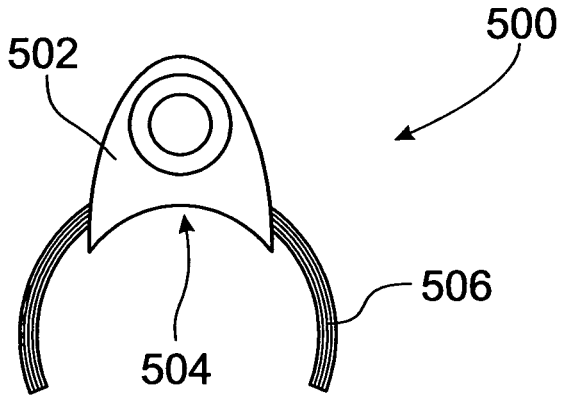
FIG. 9 shows a cross-sectional top view of another embodiment of a training aid in accordance with the invention.

Referring to FIG. 9, a cross section of another embodiment of a training aid 500 in accordance with the invention is shown. The training aid 500 is the same as any of the training aids 10, 100, 200 or 300 described hereinabove. The training aid 500 includes a housing 502 and attachment means in the form of a curved face 504 and a strap 506. The strap 506 is threaded through the housing 502 and has opposite ends which can be adjustably fixed to each other. The ends of the strap 506 may be fixed to each other by either Velcro, clips or the like. The training aid 500 is mounted to the shaft of an implement by placing the curved face 504 against the shaft, surrounding the shaft with the strap 506 and then tightening the strap 506. The training aid 500 is easily adapted to be mounted to shafts of different diameter.

Figure 10:
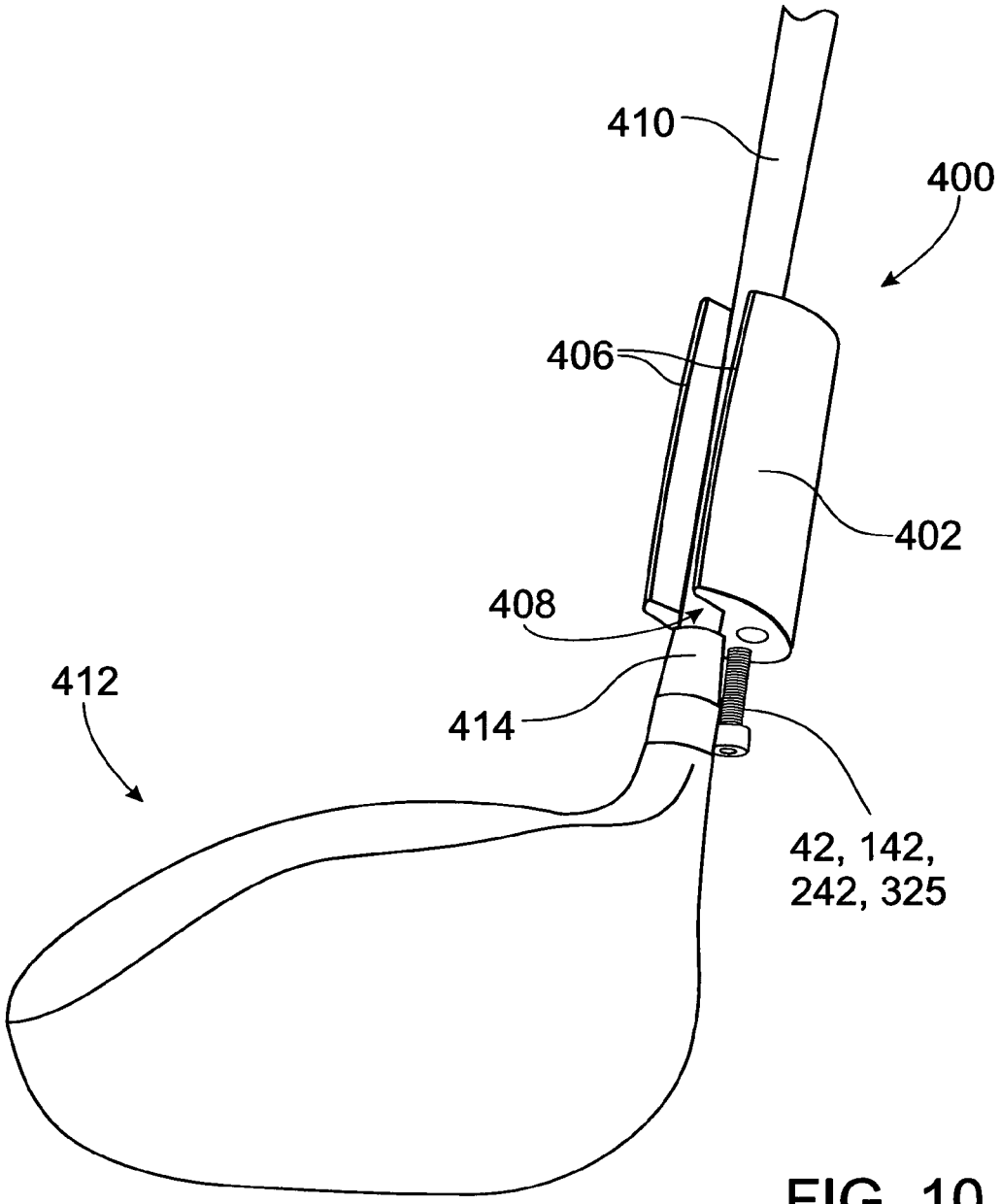
FIG. 10 shows a perspective view of a training aid of FIG. 8 mounted to the shaft of a golf club.

FIG. 10 shows the training aid 400 of FIG. 4 clipped to the shaft 410 of a golf club 412. The shaft 410 is received between the walls 406 and clipped into the channel 408 of the training aid 400. As previously mentioned, the training aid 400 is the same as any of the training aids 10, 100, 200 or 300 of FIG. 1, 2 or 3, respectively, and as such the adjuster screw/knob of the training aid 400 is indicated by reference numerals 42, 142, 242, 325. The closed end of the training aid 400 seats against the hosel 414 of the golf club 412, preventing the training aid 344 from moving further down the shaft 410 during a swing.

Figure 11:
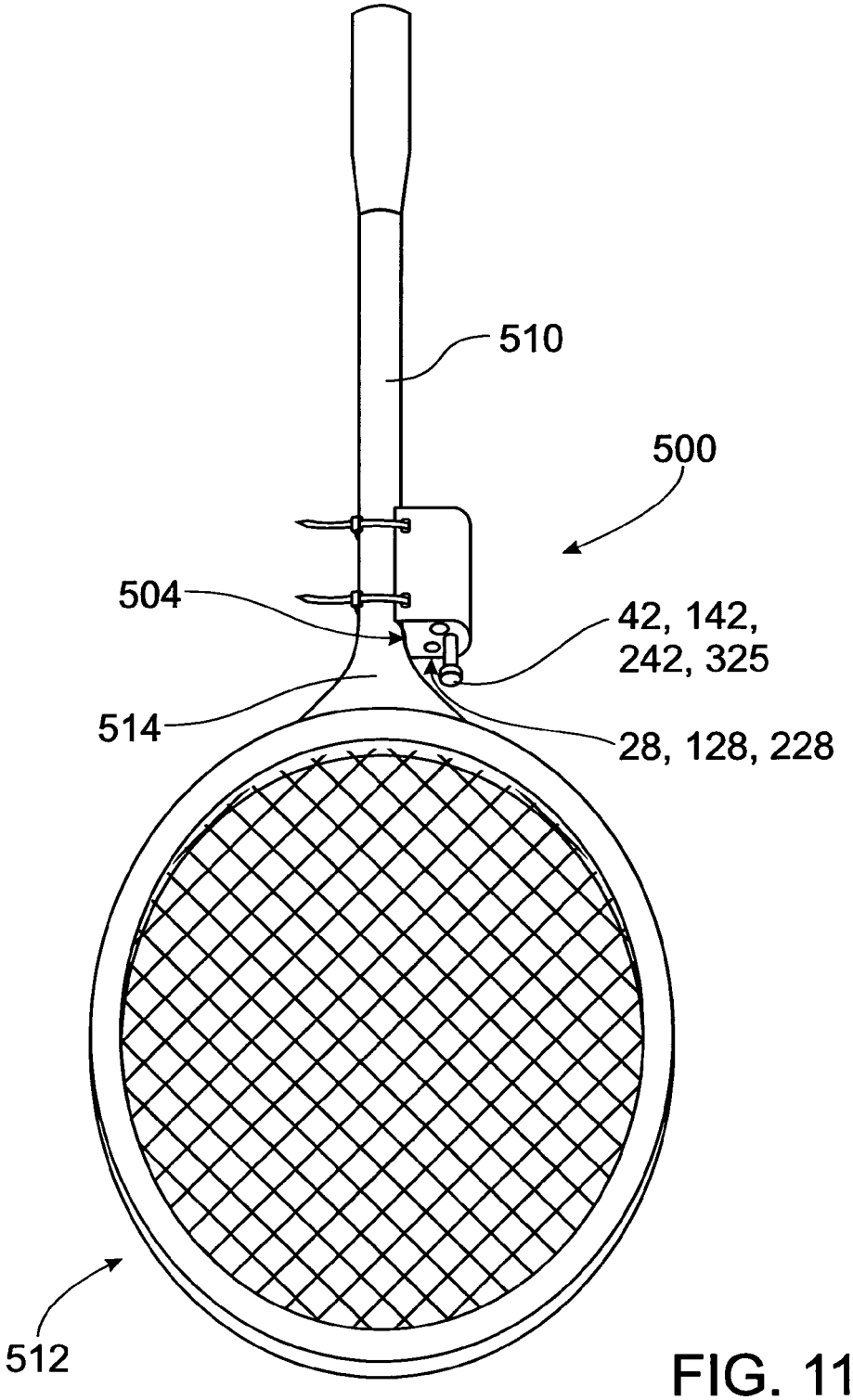
FIG. 11 shows a perspective view of the training aid of FIG. 9 mounted to the shaft of a racket.

FIG. 11 shows the training aid 500 of FIG. 9 strapped to the shaft 510 of a racket 512. The curved face 504 of the training aid 500 abuts the shaft 510. The straps 506 are in the form of cable ties which surround the shaft and securely fix the training aid 500 to the shaft 510. As previously mentioned, the training aid 500 is the same as any of the training aids 10,100, 200 or 300, respectively, and as such the adjuster screw of the training aid 400 is indicated by reference numerals 42, 142, 242. The closed end 28, 128, 228 of the training aid 500 seats against the neck 514 of the racket 512, preventing the training aid 500 from moving further down the shaft 510 during a stroke.

Figure 12:
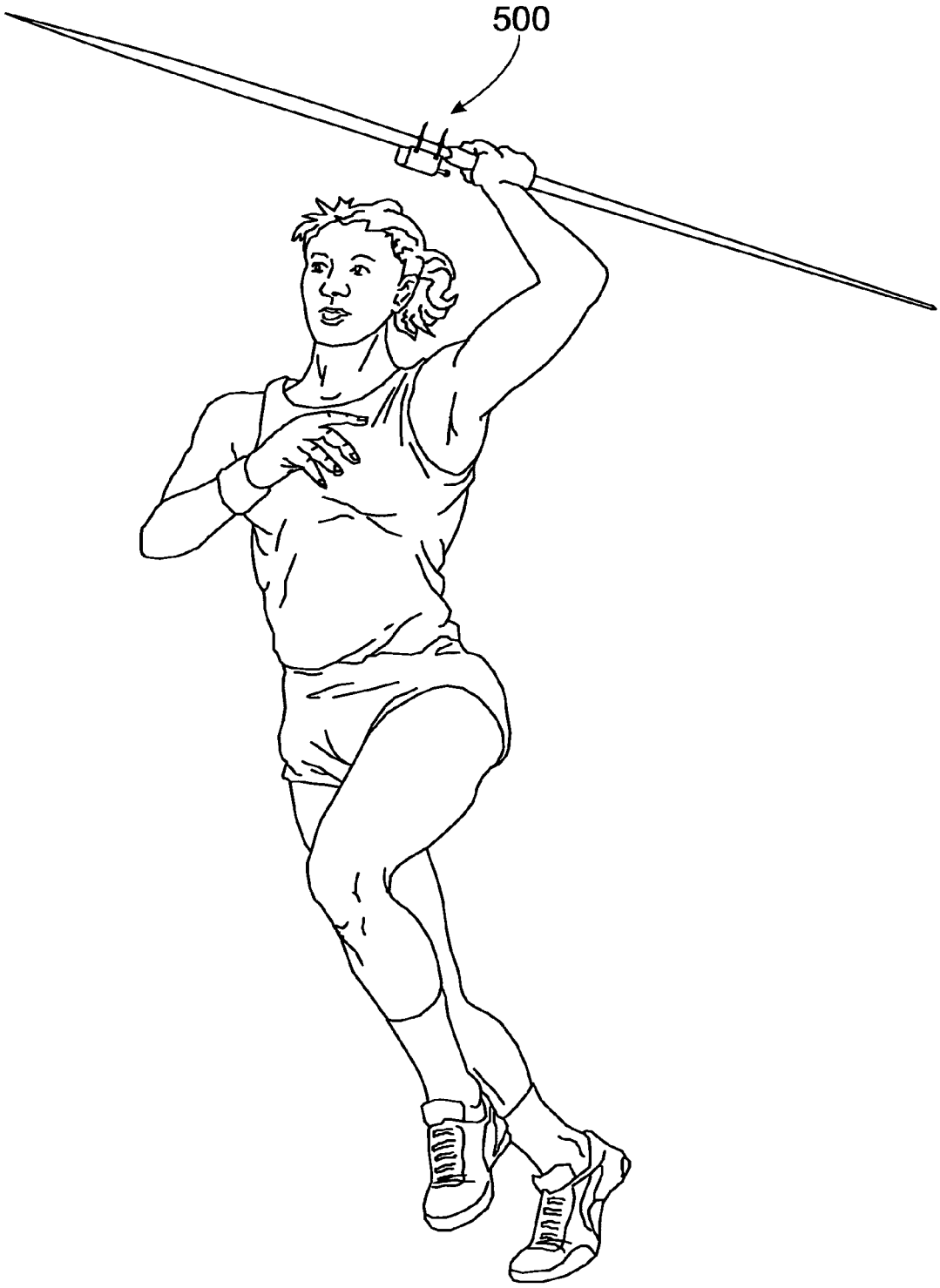
FIG. 12 shows a perspective view of the training aid of FIG. 9 mounted to the shaft of a javelin.

As described, the training aid of the present invention is thus applicable to various types of sports equipment, including golf clubs, tennis rackets, hockey sticks, baseball bats, etc. FIG. 12 shows the training aid 500 fixed to a javelin. Whereas the Applicant envisages that the training aid will mostly be used with swung implements wherein a centripetal/centrifugal force acts on the training aid, the training aid may similarly be used with sports equipment where the training aid experiences linear acceleration and a subsequent linear force.

Figure 13:
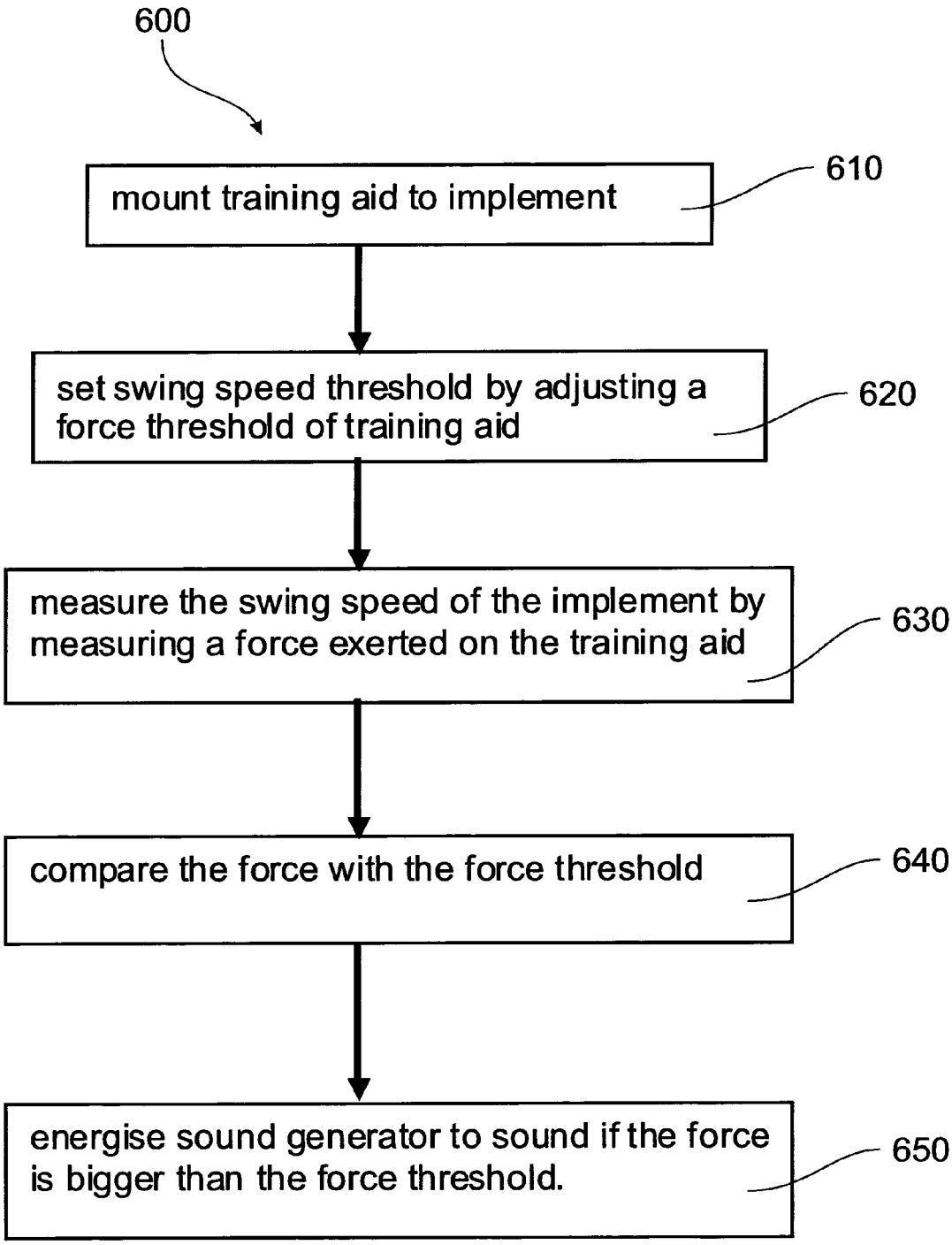
FIG. 13 shows a schematic flow diagram of a method of providing real-time audible biometric feedback during swinging of an implement, using the training aid in accordance to the invention.

FIG. 13 is a schematic flow diagram showing the basic steps of the method 600 of providing real-time audible biometric feedback during swinging of an implement, as provided by any of the training aids 10,100,200 or 300. The method 600 includes the following steps:

610) The training aid 10,100,200,300 is mounted to the shaft of a sports implement to be swung. Mounting of the training aid is described hereinabove with reference to FIGS. 8 to 11.

620) The swing speed threshold at which a sound generator of the training aid 10,100,200,300 sounds when swinging the training aid is set by adjusting a force threshold of the training aid (620).

630) The swing speed of the implement is measured by measuring a force exerted on at least part of the training aid during the course of the implement being swung.

640) A force activated switch of the training aid compares the force with the force threshold.

650) The sound generator (buzzer or sounder) of the training aid 10,100,200,300 is energised to sound if the force is bigger than the force threshold, i.e if the swing speed is higher than the swing speed threshold set by the user.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. A training aid, including:
- a housing;
- a clamp for releasably mounting the housing to an implement;
- a battery within the housing;
- a sound generator connected to the battery through an electrical circuit; and
- a force activated switch in the electrical circuit, which is activated to energise the sound generator to sound in response to displacement of the training aid, wherein the force activated switch:
- has a force threshold at which the force activated switch is activated to energise the sound generator to sound, and
- is configured so that the force threshold is user adjustable;

and wherein the force activated switch comprises:
- a force sensor outputting a force voltage which varies depending on the displacement of the training aid;
- a user adjustable potentiometer outputting a force threshold voltage which is the force threshold; and
- a voltage comparator which is operable to compare the force voltage to the force threshold voltage, wherein the force activated switch is operable to energise the sound generator when the force voltage of the accelerometer is bigger than the force threshold voltage.

2. The training aid of claim 1, wherein the force activated switch is operable to open or close the electrical circuit by being respectively open or closed, the sound generator being energised when the electrical circuit is closed.

3. The training aid of claim 1, wherein the electrical circuit of the training aid includes an on/off switch between the force activated switch and the battery, the force activated switch being energised only when the on/off switch is closed.

4. The training aid of claim 3, wherein the on/off switch comprises:
- a compression spring against which the battery acts; and
- an electrical contact of the electrical circuit, which is spaced a distance from a terminal of the battery so that the terminal of the battery contacts the electrical contact when the spring is sufficiently compressed, thereby to energise the force activated switch.

5. The training aid of claim 3, wherein the on/off switch is closed by displacement of the battery in the housing.

6. A training aid, including:
- a housing;
- a clamp for releasably mounting the housing to an implement;
- a battery within the housing;
- a sound generator connected to the battery through an electrical circuit; and
- a force activated switch in the electrical circuit, which is activated to energise the sound generator to sound in response to displacement of the training aid, wherein the force activated switch:
- has a force threshold at which the force activated switch is activated to energise the sound generator to sound, and
- is configured so that the force threshold is user adjustable;

and wherein the force activated switch comprises:
- an accelerometer outputting a force voltage which varies depending on the displacement of the training aid;
- an analog-to-digital converter connected to the accelerometer and which outputs a digital value proportional to the magnitude of the force voltage;
- a digital comparator which is operable to compare the digital value to the force threshold; and wherein the force activated switch energises the sound generator when the digital value of the accelerometer is bigger than the force threshold.

7. The training aid of claim 6, wherein the force activated switch includes a user adjustable potentiometer outputting a force threshold voltage which is converted to the force threshold by an analog-to-digital converter.

8. The training aid of claim 6, wherein the digital comparator is a microprocessor.

9. The training aid of claim 6, wherein the sound generator is energised by outputting a suitable alternating electrical current to the sound generator.

10. The training aid of claim 9, wherein the sound generator is a piezoelectric sounder.

* * * * *